United States Patent [19]

Catapano

[11] 3,988,909

[45] Nov. 2, 1976

[54] SAFETY DRUG CABINET

[76] Inventor: Joseph V. Catapano, 30 Longfellow Drive, Huntington Station, N.Y. 11746

[22] Filed: Oct. 25, 1974

[21] Appl. No.: 517,898

[52] U.S. Cl. ..... 70/63; 220/315; 312/245; 312/209

[51] Int. Cl.[2] ..... B65D 55/14; E05B 65/52

[58] Field of Search ..... 312/209, 234, 234.5, 312/245; 70/63, 312; 292/202, 211; 40/125 A

[56] References Cited

UNITED STATES PATENTS

| | | | |
|---|---|---|---|
| 2,512,028 | 6/1950 | MacMillan | 70/63 |
| 3,294,611 | 12/1966 | Vomela | 40/125 A |
| 3,393,030 | 7/1968 | Block | 312/209 |
| 3,421,347 | 1/1969 | Sotory | 70/63 |
| 3,776,006 | 12/1973 | Atkinson | 70/312 |

*Primary Examiner*—Casmir A. Nunberg
*Attorney, Agent, or Firm*—Jacob L. Kollin

[57] ABSTRACT

A safety drug cabinet comprising a housing provided with a swingable door and combination lock means for locking said door. The lock means comprises a plurality of shafts extending through the door latches secured to one of the ends of said shafts and discs indicating an open and closed position of the latches. Pressure-sensitive adhesive disks marked to indicate open and closed positions of the combination lock are secured to the disks.

2 Claims, 7 Drawing Figures

FIG. 1
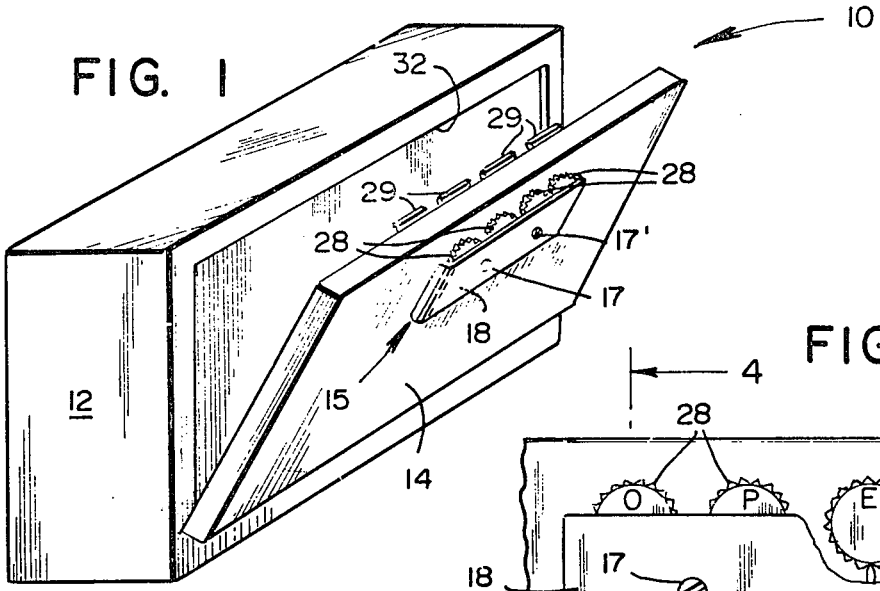
FIG. 2
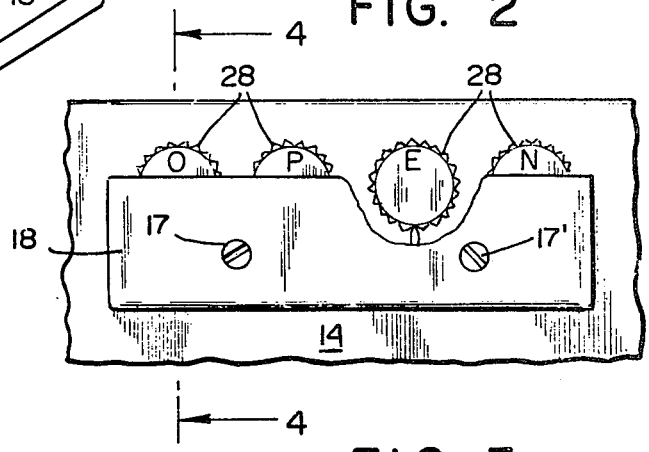
FIG. 4
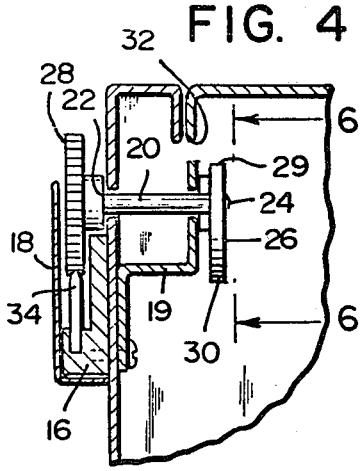
FIG. 3
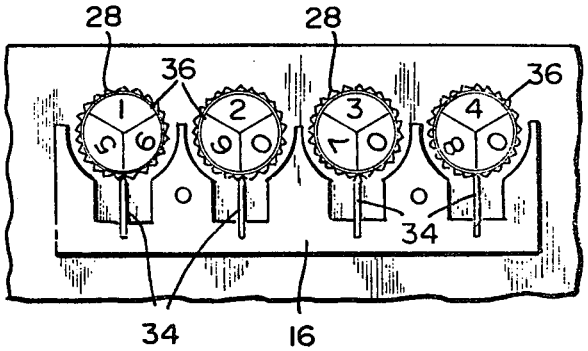
FIG. 5
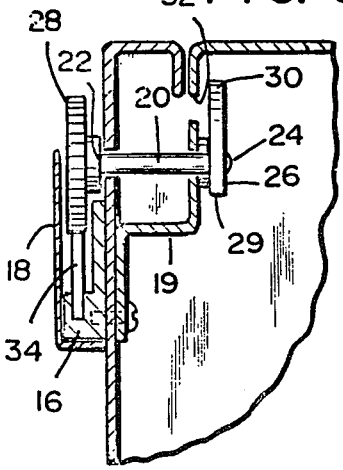
FIG. 7
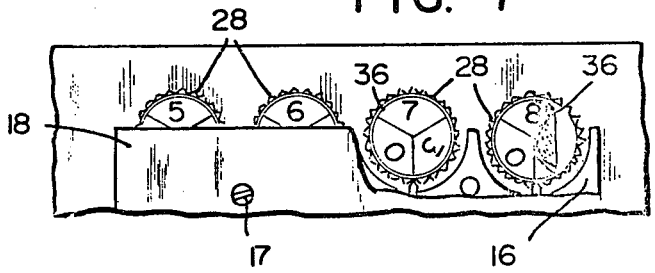
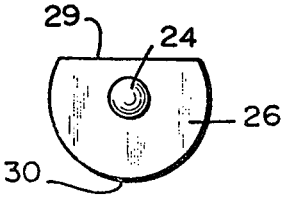
FIG. 6

SAFETY DRUG CABINET

BACKGROUND OF THE INVENTION

The invention relates to drug cabinets in general, and in particular to a drug cabinet provided with a combination lock.

An object of the invention is to provide a safety drug cabinet which will keep dangerous drugs out of the reach of curious youngsters.

Another object of the invention is to provide such a cabinet having a combination lock, requiring no use of keys.

Yet another object of the invention is to provide such a cabinet which can be attached to a medicine cabinet without the use of tools.

Still another object of the invention is to provide such a cabinet which is simple in construction and operaton and reasonable in cost. These and other objects of the invention will become apparent from the following description in connection with the appended drawing illustrating a preferred embodiment of the invention. It is to be understood, however, that these are given by way of illustration and not of limitation and that changes may be made in the detail construction, form and size of the parts, without affecting the scope of the invention sought to be protected.

In the drawings:

FIG. 1 is a perspective view of the safety drug container;

FIG. 2 is a partial front view of the door of the container with the lock open;

FIG. 3 is a view of the lock of FIG. 2, without the lock cover;

FIG. 4 is a section taken on line 4—4 of FIG. 2, showing the lock in open position;

FIG. 5 is a section similar to FIG. 4, showing the lock in closed position;

FIG. 6 illustrates the shape of the latches;

FIG. 7 illustrates the paper discs for the wheels of the combination lock.

Referring now to the drawing in detail, the safety drug cabinet, generally indicated as 10, comprise a housing 12 provided with a hinged door 14 and a multiple digit combination lock 15. Secured to the front face of the door is a front L-shaped bracket 16, to which is secured by means of screws 17,17', a cover plate 18. A second angular bracket 19 is secured to the rear face of the door 14. Mounted for rotation in the door 14 and extending through the bracket 18 are four shafts 20, spaced from one another. The ends 22,24 of the shafts extend outwardly of the door 14 and bracket 19, respectively. Secured to the ends 24, of the shafts, are half-moon shaped latches 26 having flater end portions 29 and round portions 30. To ends 22 of the shafts are secured toothed wheels 28. By rotating these wheels to a predetermined position the latches 26 can be placed in the position shown in FIG. 4, with the flat end portion 29 clearing flanges 32 of the cabinet. Rotation of the toothed wheels 28 to one of other positions will bring the round portions 30 and the latches 26 into the positions shown in FIG. 5. The cabinet edge 32 will thus be in the path of the round end portion 30 of the latches, thereby preventing the door 14 from opening. The toothed combination wheels can be retained in a desired position by resilient detent strips 34 engaging with the teeth of the wheels.

Pressure sensitive number discs 36, such as shown in FIG. 7, attachable to the wheels 28, are provided, permitting to choose a combination of easily-remembered numbers, for example 1,2,3,4, or any other combination. Each number occupies a third of a disc. The toothed combinaton wheels, illustrated in FIG. 2, are permanently marked with the letters O,P,E,N on a segment occupying one-third of the wheel's face. These lettered segments are aligned with the flat end portions 29 of latches 26. The door can therefore be opened, since the latches can clear the edge 32 of the container 12.

To place the cabinet in operation, the cover plate 18 is removed by unscrewing the two screws 17,17'. The pressure sensitive number discs 36 are secured, one at a time on the toothed combination wheels 28 with the numbers chosen, as for example 1,2,3,4, over the letters O,P,E,N (FIG. 3). The face plate 18 is screwed on the door. The safety drug container can now be locked by rotating the toothed combination wheels to any random position which will obscure the combination of numbers chosen for the O,P,E,N position, as for example the numbers shown in FIG. 7. In these positions the round end portions 30 of the latches 26 will be obstructed by the container's edge portion 32. The container will thus remain locked and medicines etc. contained therein inaccessible to children. To unlock the cabinet it is only necessary to return the combination toothed wheels to the original setting 1,2,3,4 (FIG. 3).

The safety drug cabinet is provided with a pressure sensitive adhesive on its back panel (not shown). It may be placed on a medicine cabinet shelf and secured to the cabinet's back by pushing the container straight back until it contacts the cabinet back.

I claim:

1. A safety drug cabinet comprising a housing having top, bottom, rear and side walls and an open front, a door hingedly secured to said bottom wall for closing said opening said door having a front face and a rear face and combination lock means for locking said door in closed position, said combination lock means comprising a front bracket secured to said front face, a rear bracket secured to said rear face, a plurality of rotatable shafts extending through said door and said rear bracket, a latch having a round portion and a flat portion, said latch being secured to one end of each of said shafts behind said rear bracket, a disk secured to the other end of each of said shafts, said top wall having a downwardly extending flange, said latching member being operable by rotating said shaft to engage the round portion with said flange, whereby said door will be in locked position and to disengage said latch from said flange to place the door in an unlocked position, each of said disks being inscribed with marks dividing the disk into three segments, a cover plate secured to said front bracket positioned to obscure two of said segments while exposing the third of said segments, each of said third segments being aligned with each said flat portion of said latch and having markings indicating an open position of said combination lock, when said wheel segments are exposed, a plurality of pressure-sensitive adhesive disks secured to toothed wheels, said disks having three segments marked thereon, one of each of said disk segments bearing a predetermined marking corresponding to a respective segment marking on said toothed wheel indicating an open position of said latch, and resilient detent strips secured to said bracket and engaging with said toothed wheels for retaining said wheels in a desired position.

2. The safety drug cabinet wherein as claimed in claim 1, said combination lock means comprising four shafts, four toothed wheels and four-diget pressure-sensitive adhesive disks secured to said toothed wheels respectively.

* * * * *